US005275221A

United States Patent [19]

Doehlemann

[11] Patent Number: 5,275,221

[45] Date of Patent: Jan. 4, 1994

[54] GUIDE ROD FOR WINDOW DECORATIONS OR SHADING SYSTEMS

[75] Inventor: Guenther Doehlemann, Weilheim/Teck, Fed. Rep. of Germany

[73] Assignee: Doefix-Doehlemann GmbH, Weilheim/Teck, Fed. Rep. of Germany

[21] Appl. No.: 954,261

[22] Filed: Sep. 30, 1992

[30] Foreign Application Priority Data

Oct. 14, 1991 [DE] Fed. Rep. of Germany ..... 4133985

[51] Int. Cl.[5] ..... E06B 3/94

[52] U.S. Cl. ..... 160/84.1 E; 160/84.1 F

[58] Field of Search ..... 160/84.1, 274, 275, 160/280, 276, 281, 264, 278, 283, 288

[56] References Cited

U.S. PATENT DOCUMENTS

| | | | |
|---|---|---|---|
| 2,187,242 | 1/1940 | Kesner . | |
| 2,994,370 | 8/1961 | Pinto | 160/274 X |
| 3,055,419 | 9/1962 | Rubin et al. | 160/84.1 |
| 3,156,294 | 11/1964 | Miller et al. | 160/281 X |
| 3,777,800 | 12/1973 | Susoev | 160/84.1 |
| 4,665,964 | 5/1987 | Zommers | 160/84.1 |
| 4,867,220 | 9/1989 | Matsumoto et al. | 160/84.1 X |
| 4,880,044 | 11/1989 | Judkins . | |
| 4,880,045 | 11/1989 | Stahler | 160/207 X |
| 4,932,704 | 6/1990 | Ament | 160/84.1 X |
| 5,111,866 | 5/1992 | Prustko | 160/84.1 X |

FOREIGN PATENT DOCUMENTS

| | | |
|---|---|---|
| 3225099 | 9/1983 | Fed. Rep. of Germany . |
| 3615349 | 11/1987 | Fed. Rep. of Germany . |
| 240349 | 10/1925 | United Kingdom . |

*Primary Examiner*—David M. Purol
*Attorney, Agent, or Firm*—Darby & Darby

[57] ABSTRACT

The invention relates to a guide rod for a fabric for window decoration or shading system, wherein the fabric can be gathered essentially perpendicularly to the guide rod. The rod comprises a pair of sliding pins (2), telescopingly mounted at each end of the rod so as to be slidable in the longitudinal direction of the rod, each of these sliding pins (2) having a head (3), which is held by the free edges of a C-shaped cross-section of a respective one of a pair of stationary rails (1), which may be fastened to opposite sides of the frame of the window. Each sliding pin (2) has a disc (8) seated thereon adjacent the rail. The disc is pressed toward the head (3) of the respective pin by a compression spring (9) which is braced against the adjacent end of the central rod portion and acts to clamp the pin to the rail so as to frictionally maintain the pin and thus the entire rod in a desired position along the rail. The sliding pin (2) has an abutment portion (6), which prevents the telescoping pin from being withdrawn from the end of the rod beyond the point at which the abutment engages a cooperating shoulder at the interior of the central rod portion.

11 Claims, 1 Drawing Sheet

GUIDE ROD FOR WINDOW DECORATIONS OR SHADING SYSTEMS

FIELD OF THE INVENTION

The invention relates to a guide rod for fabric or plastic sheet for window decorations or shading systems, in which the fabric or sheet can be gathered essentially perpendicularly to the guide rod, and to the curtain systems incorporating such guide rods. Such curtains may be put up as decoration, or only as protection against the sun, on windows of all types, including also motor vehicle windows.

BACKGROUND OF THE INVENTION

Guide rods of this general type are known, for example, from German Patent publication DE 3 615, 349 A1, which deals with a gathered curtain, which has guide rods that are disposed at intervals perpendicularly to the gathering direction. Gathering cords run through the guide rods and the ends of these cords are fastened to the lowest guide rod. By operating the gathering cord, the curtain is gathered or let down. The function of the guide rod is to achieve uniform folding of the curtain during the gathering. Because of the connection between the rods and the curtain, the latter can easily be taken down from the window for cleaning purposes. The gathering cord and the guide rods remain on the window and need not be unthreaded and, later on, threaded again for this purpose. Such window decorations are however suitable only for rectangular windows and vertical window areas. For so-called horizontal roof windows, the guide rods must have lateral guide elements, which run in rails and prevent sagging of the curtain. If the window is substantially inclined with respect to the vertical, gravity would no longer suffice to overcome the friction of these guide elements when the curtain is let down. Furthermore, it would be desirable to be able to decorate also other geometric window shapes, such as triangles, circles, semicircles and domes, because such shapes occur increasingly in modern house construction, particularly in so-called winter gardens.

SUMMARY OF THE INVENTION

It is an object of the invention to eliminate this deficiency of the window decoration described in the publication mentioned above. According to the invention, this is accomplished by a guide rod for window decorations of the above type having two sliding pin members, which are mounted one on each end of a central rod portion and are slidable in the longitudinal direction of the rod preferably telescoping from opposite end portions of the rod. Each of these sliding pin members has a enlarged head end and an enlarged tail end. The head end is supported in a stationary rail having a C-shaped cross-section, which is fastened to the window frame. The tail end of each of the pin members extends coaxially into the respective rod end. A compression spring is positioned coaxially around each pin member and acts between the corresponding rod end and the adjacent rail. A annular disk is interposed between the spring and the rail and is pressed by the compression spring toward the head so as to clamp the rail between the head and the disk. The other end of the spring is braced against the adjacent rod end. The tail end of each pin has an abutment, which cooperates with an internal shoulder of the rod to retain the tail end of the pin within the end of the rod. Thus, the guide rod, according to the invention, comprises a clamping mechanism at each end which permits the guide rod to be fixed in any position along the rails and to be shifted only after the clamping force, which is determined by the spring force, is overcome. Within the limits of its travel, the spring also permits a adjustment of the total length of the guide rod, so that the latter can be varied, without jamming, should the guide rails not be straight but rather curved or at an angle with respect to each other.

Reference is made to the dependent claims with respect to the preferred embodiments of the inventive guide rods.

BRIEF DESCRIPTION OF THE DRAWINGS

The invention is explained in greater detail in the following by means of a preferred embodiment and with the help of the drawings, in which.

DETAILED DESCRIPTION OF THE PREFERRED EMBODIMENTS

Figure 1:
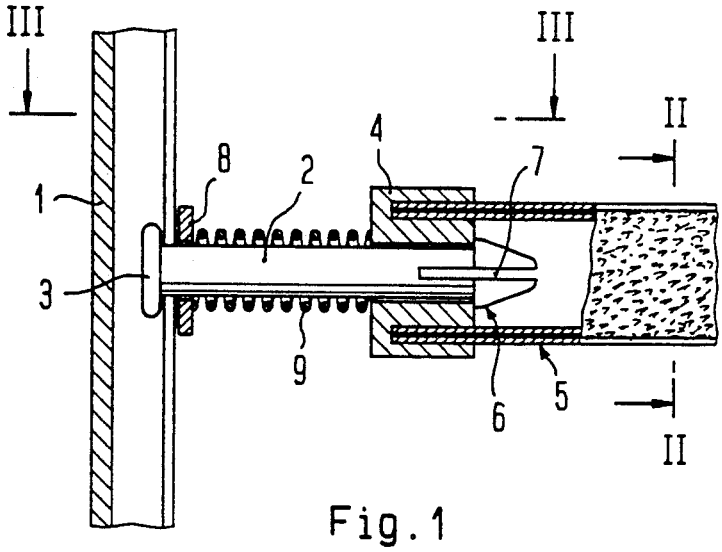
FIG. 1 shows a partially sectional view along the axis of a sliding pin member telescoping from one end of a guide rod, according to the invention and slidingly received in a stationary guide rail.
Figure 3:
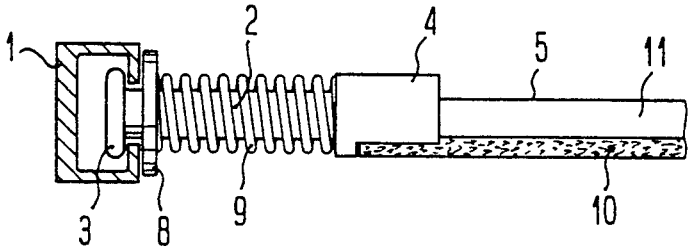
FIG. 3 shows an orthogonal section through the guide rod of FIG. 1 along the sectional line III—III.
Figure 4:
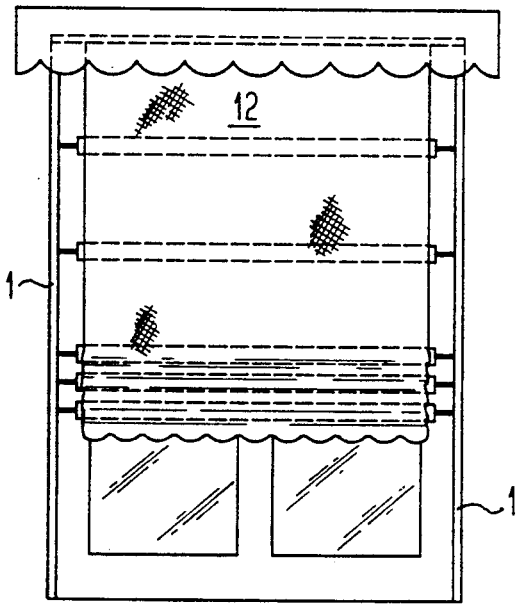
FIG. 4 diagrammatically shows a window decoration system for a rectangular window with guide rods according to the invention.

In FIGS. 1 and 3, a rail 1 is shown, which is stationary, is fastened to a window frame that is not shown and, as shown in FIG. 3, has a C-shaped cross-section. The rail may be straight as shown in FIG. 4 or may be curved, in conformity with a circular, semicircular or dome-shaped window as, for example, in FIG. 5.

Each of the pins 2 has a enlarged head 3 and an opposite enlarged tail end portion 6. The head 3 is slidingly received in the internal channel in the rail 1 formed by the free ends of the C-shaped cross-section of the rail 1. The pins 2 are telescopingly received in the opposite end portions 4 of a central rod portion 5 and, moreover, in such a manner, that they can slide freely in a central axial bore of the end portions 4 and are prevented by a shoulder on the tail end cooperating with an abutment surface around the bore which extends thru the end portion 4, from falling out of the end portion 4. The tail end 6 of the pin 2 is provided, in the region of the shoulder thereof, with a longitudinal slot 7, which confers a certain elasticity to this tail end, so that, for assembly, the sliding pin 2 can be pushed into the end portion 4 by deformation of the conical tail end, only to snap once again into the original shape shown so as to be retained in the rod, in the position shown in FIG. 1.

An annular disk 8 of plastic or metal, such as steel is preferably positioned on pin 2 adjacent the rail 1. A compression spring 9, which is braced against the disk 8 and against the adjacent end face of the end piece 4, is positioned around and is coaxial with, pin 2. Spring 9 forces the disk 8 toward the head 3 and against the outer surface of the rail 1, when the head 3 is received in the rail 1, as shown. The force of the spring 9 is chosen such that the pin 2 is held by friction in a desired location along the rail 1 and, when external forces are applied thereto such as, for example, by hand or otherwise, the pins 2 will slide along the respective rail.

Figure 2:
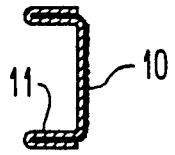
FIG. 2 shows a section through the guide rod along the line II—II of FIG. 1.

The pins 2 and the end pieces 4 of the rod, can be made of plastic. The central portion of guide rod 5 can be tubular and may be provided over the whole of its circumferential surface with a Velcro or similar structure having adhesive-like properties for attachment and ready detachment of curtains, or the like. In the example selected here, the Velcro or similar structure is on only one side of the guide rod and consists of a flat Velcro strip 10, which is inserted in a sheet-metal section 11 of U-shaped cross-section. The free legs of the U-shaped section are bent back on themselves towards the outside and clamp the two side edges of the flat Velcro strip (see FIG. 2). This metal section is pressed into cavities in the end piece 4, which have been machined to fit.

FIG. 4 shows a shade, or curtain, 12, onto which looped ribbons, which are adapted to be connected with the strips 10 of the guide rods, are sewn or glued. A pair of stationary rails 1, in which the two ends of the guide rods are guided as shown, is attached to the side frames of a rectangular window. Not all the guide rods need have the inventive sliding pins. In the limiting case, only the lowest guide rod is equipped with such a sliding pin mechanism, so that the curtain can easily be opened and closed by moving this guide rod by hand or with the help of a rod. As with a roller blind, the curtain according to the present invention remains standing at any height without, however, requiring a spring-actuated roller blind mechanism. Thus, the inventive guide rod can be used to advantage for decorating a vertical and rectangular window as replacement for a spring-actuated roller blind. In the case of an inclined roof window, several or all the guide rods may be constructed pursuant to the invention, so that unsightly sagging of the fabric panel is prevented.

Figure 5:
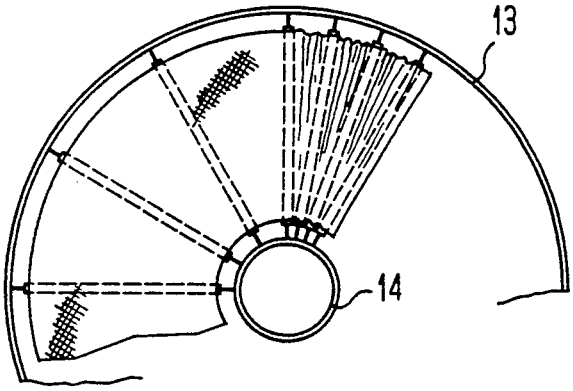
FIG. 5 diagrammatically shows a winter garden dome, the curtain of which is equipped with the guide rods according to the invention.

FIG. 5 shows an application of the inventive guide rod to a circular dome of a winter garden. In this embody the guide rods 5 extend between a pair of circular, concentric, rails 13 and 14. In the right part of the Figure, the curtain is shown in gathered condition and, in the left part, it is shown in closed condition. In this case, it is particularly important that the sliding pins are movable in the direction of the axis of the rod, so that the total length of the guide rod can be adapted, within limits, to varying distances between the rails. Such distance variations can be due to installation inaccuracies, but can also result from inaccurate operation, as a result of which the rods may be shifted from their essentially radial position. Thanks to the automatic longitudinal length adjustment capability provided by the pin/spring mechanism of the present invention, such inaccuracies will not cause jamming, particularly since the head 3 of the sliding pins is pressed only by the force of the spring 9 into a position parallel to the disk 8 and thus can also sit at an angle in the guide rail, without adversely affecting the movability of the guide rod thereby. The decoration of a window with a semicircular upper edge forms an application which is similar to that of a dome. In the latter case, the semicircular region can be decorated in a manner similar to that shown in FIG. 5 for a dome.

It will be understood that the invention is not limited to the preferred embodiment shown which is shown only for the purpose of illustration and not limitation. For example, the rod can be fastened to the fabric by other means than a Velcro connection. In particular, pockets, through which the guide rods are placed, can be sewn into fabric of the shade, or curtain.

What is claimed is:

1. An elongated guide rod for a window curtain or shade system in which fabric can be gathered transversely to the guide rod, comprising: a pair of stationary rails adapted to be mounted in parallel spaced relation to one another, each said rail having a generally C-shaped cross-section; a rod member spanning a substantial portion of the distance between said pair of rails; a pair of telescoping pin members one at each of the rod member and movable relative to said rod member in the direction of elongation of the rod member for spanning the remaining distance between said pair of rail; each of said pin members having an enlarged head portion at one end adapted to be slidingly received in a respective one of said stationary rails for sliding movement therealong and having an enlarged tail portion at the other end thereof; said rod member having a pair of opposed end portions for slidingly receiving therein said telescoping pin members; a pair of compression springs respectively braced between the rod member and the respective rail adjacent thereto for urging said rod member in a direction away from said rail; each of said pin members having a respective end with a stop means for preventing said pin member from projecting from said rod member beyond a desired distance; and means on said rod member for attachment thereto of a curtain or shade material.

2. The guide rod of claim 1, wherein each of said pin members has a cylindrical neck in a region between the head and the tail portions thereof which is slidingly received in a bore in a corresponding one of said end portions of said rod member, said tail portion having a diameter which is larger than that of the bore and said tail portion being tapered and having a central slot so as to be elastically deformable, said enlarged tail portion being elastically deformed to a size allowing said tail portion to be pushed through the bore in said end portion and to snap into a condition which retains said tail portion in place once pushed through.

3. The guide rod of claim 1, wherein said guide rod has a central curtain attachment portion having opposite ends and said pair of end portions comprising means for frictionally securing thereto said opposite ends of said central curtain attachment portion.

4. The guide rod of claim 3, wherein said central portion comprises an elongated section having a U-shaped cross-section having an outer surface and means on the outer surface of said U-shaped section for adhering curtain material thereto.

5. The guide rod of claim 4, wherein the curtain adhering means is a flat strip of material with engaging hooks and loops and with spaced side edges, said U-shaped cross-section having opposed free legs which are bent back onto themselves and clamping the two side edges of the flat strip.

6. The guide rod of claim 1 further comprising an annular disc between said spring and said rail, said spring urging said disc against said rail for frictionally holding said rod member in a desired location along said rail by a friction force and for allowing said rod member to be moved along said rail in response to a force applied to said rod member, in a direction parallel to said rail, sufficient to overcome said friction force.

7. The guide rod of claim 4, wherein said elongated section is sheet aluminum.

8. A guide rod for a window curtain or shade system in which the fabric of the curtain or shade can be gathered transversely to an axis of the guide rod, said guide rod operating between a pair of stationary guide rails mounted on a window frame in parallel spaced relation to one another, each such rail having a generally C-shaped cross-section, the guide rod comprising:

a central rod member spanning a substantial portion of a distance between said pair of stationary guide rails and including means for attachment and detachment thereto of curtain or shade material; and a pair of spring means, one at each end of said rod member and operatively and integrally connected thereto, each of said spring means having a pin member telescoping from and slidingly received in a corresponding one of said ends of said rod member, each said pin member having an enlarged head end slidingly received in a corresponding one of said rails adjacent thereto, and enlarged tail end being confined in said rod member and a pair of compression springs each acting between the one of the end portions of the rod member and corresponding one of said rails, whereby the rod is frictionally held in any desired location between the pair of stationary guide rails.

9. The guide rod of claim 8 further comprising an annular disc between said spring means and a corresponding one of said rails, said spring urging said disc and said head end against opposed surfaces of said corresponding one of said rails for clamping said corresponding one of said rails therebetween for frictionally holding said central rod member in a desired location along said rail.

10. A curtain system comprising a pair of stationary parallel rail members adapted to be fastened to opposite sides of a window frame, respectively, each of said rail members having a C-shaped cross-section; a plurality of elongated guide rod means extending between said rail members and having opposite ends thereof slidingly received in respective ones of said rail members; a curtain material including means at spaced locations therealong for removable attachment thereof to said plurality of elongated guide rod means, respectively, said plurality of elongated guide rod means including at least one rod member spanning a substantial portion of the distance between said pair of rail members; a pair of telescoping pin members, one at each end of the rod member and movable relative to said rod member in a longitudinal direction thereof for spanning a remaining distance between said pair of rail members; at least one of said pin members having a head portion at one end cooperating with one of said rail members for movement therealong and having a tail portion at the other end thereof, said rod member having a pair of opposed end portions for slidingly receiving said telescoping pin members; spring means cooperating with said rod member and said one pin member for urging said pin member into friction engagement with said one rail member; and at least said one pin member having a stop means cooperating with said rod member for retaining said tail portion of said pin member therein.

11. An elongated guide rod for a window curtain or shade system for mounting on a window frame, in which curtain material can be gathered transversely to a direction of elongation of the guide rod, comprising: a pair of stationary guide rails adapted to be mounted on the window frame in spaced relation to one another; a rod member spanning a substantial portion of the distance between said pair of rails; a pair of telescoping pin members, one at each end of the rod member and movable relative to said rod member in a longitudinal direction thereof for spanning a remaining distance between said pair of rails; at least one of said pin members having a head portion at one end cooperating with one of said rails for movement therealong and having a tail portion at the other end thereof; said rod member having a pair of opposed end portions for slidingly receiving said telescoping pin members; spring means cooperating with said rod member and said one pin member for urging said pin member into friction engagement with said one rail; and; at least said one pin member having a stop means cooperating with said rod member for retaining said tail portion of said pin member therein.

* * * * *